US011148436B2

(12) United States Patent
Schlatterbeck et al.

(10) Patent No.: US 11,148,436 B2
(45) Date of Patent: Oct. 19, 2021

(54) METHOD AND DEVICE FOR INK-JET APPLICATION ON SHEET-TYPE SUBSTRATES

(71) Applicant: ACTEGA Schmid Rhyner AG, Adliswil-Zürich (CH)

(72) Inventors: Dirk Schlatterbeck, Friltschen (CH); Walther Krull, Lübeck (CH)

(73) Assignee: ACTEGA Schmid Rhyner AG, Adliswil-Zürich (CH)

( * ) Notice: Subject to any disclaimer, the term of this patent is extended or adjusted under 35 U.S.C. 154(b) by 0 days.

(21) Appl. No.: 16/332,195

(22) PCT Filed: Sep. 12, 2017

(86) PCT No.: PCT/EP2017/072823
§ 371 (c)(1),
(2) Date: Mar. 11, 2019

(87) PCT Pub. No.: WO2018/050617
PCT Pub. Date: Mar. 22, 2018

(65) Prior Publication Data

US 2019/0224968 A1 Jul. 25, 2019

(30) Foreign Application Priority Data

Sep. 13, 2016 (DE) ..... 102016117211.1

(51) Int. Cl.
*B41J 2/21* (2006.01)
*B41J 2/205* (2006.01)
(Continued)

(52) U.S. Cl.
CPC ..... *B41J 2/2139* (2013.01); *B41J 2/04593* (2013.01); *B41J 2/14* (2013.01);
(Continued)

(58) Field of Classification Search
CPC ..... B41J 2/2146; B41J 2/2114; B41J 2/155; B41J 19/14; B41J 19/00; B41J 2/515;
(Continued)

(56) References Cited

U.S. PATENT DOCUMENTS 9,126,445 B1 9/2015 Spence et al.
2002/0030708 A1 3/2002 Yoshida
(Continued)

FOREIGN PATENT DOCUMENTS

CN 1504341 6/2004
CN 1623782 6/2005
(Continued)

OTHER PUBLICATIONS

Authorized Officer Nora Lindner, International Preliminary Report on Patentability issued in PCT Application No. PCT/EP2017/072823 and dated Mar. 28, 2019.
(Continued)

*Primary Examiner* — Justin Seo
(74) *Attorney, Agent, or Firm* — Kaplan Breyer Schwarz, LLP

(57) ABSTRACT

A method for printing sheet-type substrates to prevent streaks during the ink-jet paint coating of substrates, includes moving a substrate in a feed direction past an application device by means of a conveying device, applying with the application device, during the movement of the substrate, a fluid application material drop by drop to the surface of the substrate in a pattern with a pre-defined contour, in particular leaving out regions, through a plurality of ink-jet nozzles arranged in a row transversely to the feed direction, in response to computer-controlled switching signals, and during the application of the pattern and during the movement of the substrate, moving the ink-jet nozzles back and forth transversely to the feed direction, preferably in the
(Continued)

longitudinal direction of the arranged row of ink-jet nozzles, such that the paths travelled by the nozzles over the substrate by the overlap of the movement back and forth with the movement in the feed direction have direction components running perpendicular to the feed direction.

14 Claims, 7 Drawing Sheets

(51) Int. Cl.

| | |
|---|---|
| ***B41J 19/14*** | (2006.01) |
| ***B41J 19/00*** | (2006.01) |
| ***B41J 2/515*** | (2006.01) |
| ***B41J 25/00*** | (2006.01) |
| ***B41J 2/045*** | (2006.01) |
| ***B41J 2/155*** | (2006.01) |
| ***B41J 2/14*** | (2006.01) |
| ***B41J 2/145*** | (2006.01) |
| ***B41J 3/54*** | (2006.01) |
| *B05B 13/04* | (2006.01) |

(52) U.S. Cl.
CPC ..... *B41J 2/145* (2013.01); *B41J 2/155* (2013.01); *B41J 2/205* (2013.01); *B41J 2/2052* (2013.01); *B41J 2/2114* (2013.01); *B41J 2/2121* (2013.01); *B41J 2/2135* (2013.01); *B41J 2/2146* (2013.01); *B41J 2/515* (2013.01); *B41J 3/543* (2013.01); *B41J 19/00* (2013.01); *B41J 19/14* (2013.01); *B41J 19/142* (2013.01); *B41J 19/145* (2013.01); *B41J 19/147* (2013.01); *B41J 25/001* (2013.01); *B41J 25/003* (2013.01); *B05B 13/041* (2013.01)

(58) Field of Classification Search
CPC . B41J 25/001; B41J 2/51; B41J 19/145; B41J 2/2052; B41J 2/2121; B41J 25/003; B41J 19/142; B41J 19/147; B41J 2/14; B41J 2/145; B41J 3/543; B41J 2/2135; B41J 2/2139; B41J 2/205; B05B 13/041
See application file for complete search history.

(56) References Cited

U.S. PATENT DOCUMENTS

| | | | | |
|---|---|---|---|---|
| 2005/0156975 | A1 | 7/2005 | Inoue | |
| 2007/0176953 | A1* | 8/2007 | Han | B41J 2/0451 347/14 |
| 2009/0225143 | A1* | 9/2009 | Fukui | B41J 2/2114 347/102 |
| 2010/0002051 | A1 | 1/2010 | Yoshimura | |
| 2010/0045716 | A1 | 2/2010 | Sugahara | |
| 2011/0242187 | A1 | 10/2011 | Mongeon et al. | |
| 2011/0247511 | A1 | 10/2011 | Carlson et al. | |
| 2012/0293593 | A1* | 11/2012 | Kondo | B41J 2/2114 347/102 |
| 2012/0314003 | A1 | 12/2012 | Kersey | |
| 2014/0015881 | A1 | 1/2014 | Veis | |

FOREIGN PATENT DOCUMENTS

| | | | |
|---|---|---|---|
| CN | 1668386 | | 9/2005 |
| CN | 1907708 | | 2/2007 |
| CN | 101264690 | | 9/2008 |
| CN | 101444959 | | 6/2009 |
| CN | 101827658 | | 9/2010 |
| CN | 102442099 | | 5/2012 |
| CN | 102756574 | | 10/2012 |
| CN | 103201114 | | 7/2013 |
| CN | 103481670 | | 1/2014 |
| CN | 103842180 | | 6/2014 |
| CN | 104619503 | | 5/2015 |
| CN | 104972772 | | 10/2015 |
| DE | 102011082316 | A1 | 4/2012 |
| EP | 2716462 | A1 | 4/2014 |
| GB | 2483473 | A | 3/2012 |
| JP | 08-118679 | | 5/1996 |
| JP | 2000-158670 | | 6/2000 |
| JP | 2004-058282 | | 2/2004 |
| JP | 2006-142807 | | 6/2006 |
| JP | 2007-144775 | | 6/2007 |
| JP | 2009-119764 | A | 6/2009 |
| WO | 2003/099456 | A1 | 12/2003 |
| WO | 2009/012996 | A2 | 1/2009 |
| WO | 2015/185160 | A1 | 12/2015 |
| WO | 2017/009705 | A2 | 1/2017 |

OTHER PUBLICATIONS

Authorized Officer: Hartmann, Mathias, International Search Report issued in PCT patent application No. PCT/EP2017/072823, dated Feb. 5, 2018, 22 pp.
English Translation of Office Action issued in Chinese Patent Application No. 201780070079.7 dated Jun. 3, 2020.
Office Action issued in corresponding Chinese patent application No. 201780070079.7, dated Jan. 8, 2021, 27 pp.

* cited by examiner

METHOD AND DEVICE FOR INK-JET APPLICATION ON SHEET-TYPE SUBSTRATES

FIELD OF THE INVENTION

The invention relates generally to the processing of substrates by printing, in particular the printing or coating of sheet-type substrates, such as for instance printed products, paper and paperboard, with color information and/or raised plastic layers.

BACKGROUND

The printing industry is in the course of a conversion process, wherein the conventional methods are increasingly being replaced by digital methods. At the same time subsequent finishing of printed materials is gaining in importance. For premium printed materials and packagings in particular, a post-processing of the imprinted substrate has largely gained acceptance.

In this case so-called print finishing processes have become established, in which printed products with raised, haptically detectable coatings are provided. For example, printing sheets for the production of paper or cardboard packagings are provided with such coatings in order to implement specific design ideas.

Various coating methods are known from the prior art in order to produce the above-mentioned layers which are raised or in relief. A comparatively new method in this connection is coating by means of inkjet technology. The production of the coatings by inkjet technology is described in WO 2003/099456 A1 and WO 2009/012996 A1.

In contrast to conventional methods, in which a printing form is produced which contains the entire substrate to be printed, in digital methods each dot is generated individually. The most widely used method is printing with ink-jet print heads (inkjet-print heads). In this case the price is determined by the nozzles used.

For printing with ink-jet print heads having a plurality of nozzles, a method is known which enables printing of any substrate widths by movement of the print heads in a direction perpendicular to the substrate movement. In this case the substrate is stopped in each case for the head movement and the print head prints the substrate widthways. This operation is described by the English term "scanning mode".

Ink-jet print heads have the characteristic that over the service life the nozzles of the print head can exhibit certain deviations of the droplet ejection from the direction perpendicular to the nozzle plate. This characteristic can already play a part from the commencement of use of the head, but usually becomes more pronounced over the period of use. Moreover, manufacturing tolerances in the production of the heads can lead to inaccuracies of the droplet positioning.

As a result of said characteristics the printed image from ink-jet print heads typically exhibits some streaks. This is aggravated by the fact that in use nozzles can fail temporarily and even permanently. A temporary failure of nozzles is usually countered by ejecting liquid from the reservoir through the nozzles (the English term "purging" has become established for this) and removing the discharged material from the nozzle plate. This reconditioning of the nozzle is associated with an interruption of the printing process and reduces the productivity of the printing unit. The permanent failure of nozzles of a print head can generally only be remedied by complete replacement of the entire print head.

In the above-mentioned technology of the "scanning mode" by movement of the heads and the widthways printing of substrates, streaking is countered by statistical positioning of droplets within a raster line from various nozzles. Due to this statistical structure of the printed image, missing nozzles can be tolerated, or compensated for, to a certain degree.

Since the ink-jet print heads have become increasingly reliable and the price per nozzle becomes more favorable, construction of single-pass printing machines has become established in order to increase the productivity. In these machines the heads are arranged so that the nozzle rows are arranged transversely, typically substantially perpendicularly to the substrate movement. If required, the heads with the rows of nozzles can also be arranged at an angle deviating from the perpendicular direction in order to achieve a higher resolution. This type of use basically means that a droplet path on the substrate in parallel with the substrate movement originates from precisely defined nozzles.

If in each case only one nozzle per droplet path is present on the substrate, a deviation of the droplet direction as described above leads to streaking. The malfunction of nozzles has an even more striking effect. This problem occurs especially in the application of curable varnish or coating components which are suitable for the production of raised coatings.

Nevertheless, therefore, in order to ensure some statistics in the nozzle selection, in single-pass operation a plurality of nozzle rows can be arranged one behind the other and are then used alternately or randomly for producing the individual droplets in a droplet path. As a result, as in the scanning mode with statistical selection of nozzles for individual droplet positions the streaking and the malfunction of nozzles can be somewhat hidden.

However, this solution is technically very elaborate and, in addition, expensive. Therefore, a simpler arrangement by which streaks in the printing or coating pattern can be avoided would be desirable. This object is achieved by the subject matter of the independent claims. Advantageous modifications are set out in the claims which are dependent thereon.

SUMMARY

Accordingly the invention provides a method for printing sheet-type substrates, in which

- a substrate is moved in a feed direction past an application device by means of a conveying device and
- during the movement of the substrate the application device applies a fluid application material drop by drop to the surface of the substrate forming a pattern with a pre-defined contour, in particular leaving out regions, through a plurality of ink-jet nozzles arranged in a row transversely to the feed direction, in response to computer-controlled switching signals, wherein
- during the application of the pattern and during the movement of the substrate the ink-jet nozzles are moved back and forth transversely to the feed direction, preferably in the longitudinal direction of the arranged row of ink-jet nozzles, such that the paths travelled by the nozzles over the substrate by the overlap of the movement back and forth with the movement in the feed direction do not lie completely parallel to the substrate movement but have direction components running perpendicular to the feed direction. Due to the movement back and forth components in opposite directions relative to one another or antiparallel direction components are generally present in the paths. By way of example this results in paths in the form of wavy lines or zigzag-lines. The movement of the nozzle can be periodic or can even take place statistically.

The conveying device can be a web feeding device in a roll-to-roll printing machine in which a substrate web is moved past the print heads. Accordingly, a substrate in the form of a substrate for printing, or substrate web, respectively, in particular made of paper or paperboard, which is rolled up to a roll, is printed in this device. By means of the conveying device the print document is unrolled, guided through the device and after printing is rolled up again.

The fluid application material can be a color, or an ink-jet ink, so that a pattern in the form of a color printed image is produced by the application. In this case the term "color printed image" should generally be understood as a pattern contrasting with the substrate. Accordingly, in this context, as is conventional in the printing industry, black is also understood as a print color.

According to another embodiment of the invention a polymer coating is applied by the method. For this purpose, a fluid organic polymer material is applied by the ink-jet nozzles and after the application the film is cured to a firm polymer coating. This polymer layer can also be transparent and colorless.

The ink-jet nozzle can be moved individually or in groups. It is particularly simple to fix the ink-jet nozzles in a common holder, which can also be designated as a printing bar, and then to pivot this holder transversely to the transport direction.

A streaked visual appearance of the coating can be very effectively countered by the additional movement back and forth of the nozzle. A small amplitude of the movement is sufficient for this purpose. In this case the amplitude is not greater than 300 times the nozzle spacing, preferably not greater than 100 times the nozzle spacing, particularly preferably not greater than ten times five times the nozzle spacing, measured from the center of one nozzle to the center of an adjacent nozzle. In the event of failure or ejection reduction of an individual nozzle streaking can already be suppressed if the amplitude is less than or equal to the simple nozzle spacing.

BRIEF DESCRIPTION OF THE DRAWINGS

The invention is explained in further detail below with reference to the accompanying drawings. In the drawings.

DETAILED DESCRIPTION

Figure 1:
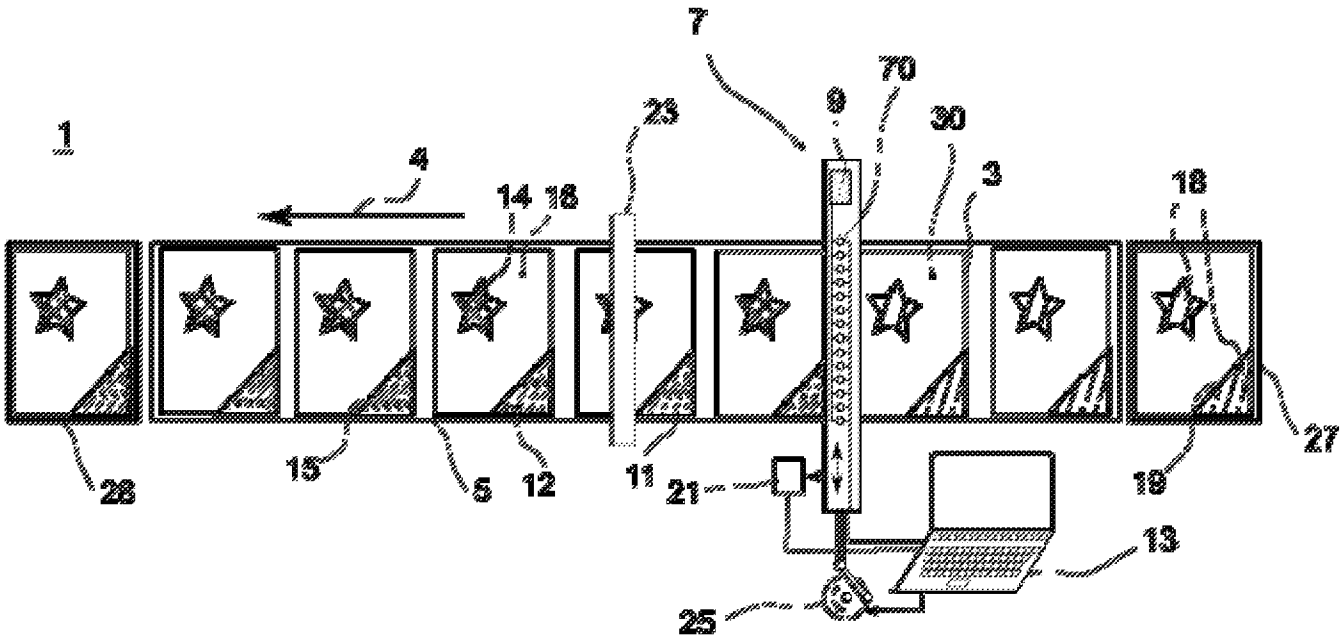
FIG. 1 shows a first embodiment of a device for carrying out the method.

FIG. 1 shows an example of a device 1 for carrying out the method described above. Without limitation to the specific illustrated example, a device 1 according to the invention for coating sheet-type substrates 3 with polymer coatings comprises an application device 7, a control device 13 and a conveying device 5, in order to move a substrate 3 in a feed direction 4 past the application device 7, wherein the application device 7 comprises a plurality of ink-jet nozzles 70 arranged in a row transversely to the feed direction, and the control device 13 is configured for generating computer-controlled switching signals by means of which the ink-jet nozzles 70 dispense a fluid application material 9 drop by drop, wherein the control device 13 is furthermore configured to actuate the ink-jet nozzles in such a way that a fluid film 11 of the application material is applied to the surface 30 of a passed substrate 3 in the form of a pattern 14 having pre-defined contours 15, in particular leaving out regions 16. According to one embodiment, inks are provided as fluid application material, so that a printed image is printed onto the substrate 3 by the method. In this case the printing with inks can be provided with a polymer coating both alternatively to the above-mentioned coating and also in addition to such a coating.

Furthermore, according to a further embodiment the device 1 has a curing device 23 in order to cure the fluid film 11 to a firm polymer coating 12 after the application.

In any case, however, a moving device for moving the inkjet nozzles 70 is provided in order so that during the application of the pattern 14 and during the movement of the substrate 3 the ink-jet nozzles 70 are moved back and forth transversely to the feed direction 4, preferably in the longitudinal direction of the arranged row of ink-jet nozzles 70, such that the paths travelled by the nozzles 70 over the substrate 3 by the overlap of the movement, for example periodically, back and forth with the movement in the feed direction 4 have direction components running perpendicular to the feed direction. In this case, in particular, the paths are configured as wavy lines.

In the illustrated example the conveying device 5 comprises a conveyor belt onto which the substrates 3 are set down. The substrates 3 in the form of pre-printed printing sheets are taken up from a magazine 27 and set down on the conveyor belt.

The nozzles 70 are connected to a reservoir in which the fluid application material 9 is held. According to one embodiment, radiation-curable, in particular UV-curable organic preparations are used as fluid organic coating material. For example, reactive acrylates in a mixture with photoinitiators can be used for this purpose. For stabilization of UV-curing paints the curing device 23 correspondingly has a UV radiation source.

Merely by way of example, as a moving device 25 a drive having an eccentric is illustrated, by means of which the holder on which the ink-jet nozzles 70 are fastened is pivoted transversely, in particular perpendicularly to the feed direction of the conveying device 5.

The substrates 3 are printed with a printed image 18. The individual elements of the printed image are delimited by a contour 19. In a preferred embodiment of the invention, such a substrate 3 printed with a printed image 18 is now provided with the polymer coating in such a way that the printed image 18 corresponds to the pattern 14 of the coating 12. The pattern 14 can correspond in particular to the printed image in such a way that the contours 15, 19 of the printed image 18 and the pattern 14 run at least partially parallel, preferably as illustrated at least partially congruently. Merely by way of example the printed image comprises an imprinted corner and an imprinted star. The polymer coating 12, as a raised coating, then for example covers the imprinted regions and is delimited by contours 15 which are congruent with the contours 19 of the printed image 18. The coating takes place while leaving out the region 16 of the surface 30 between the elements of the printing. Of course, these regions can also likewise be printed, but the regions covered by the polymer coating 12 are elements which stand out visually through their contours 19 (this finishing technique is also designated as "spot coating").

Figure 2:
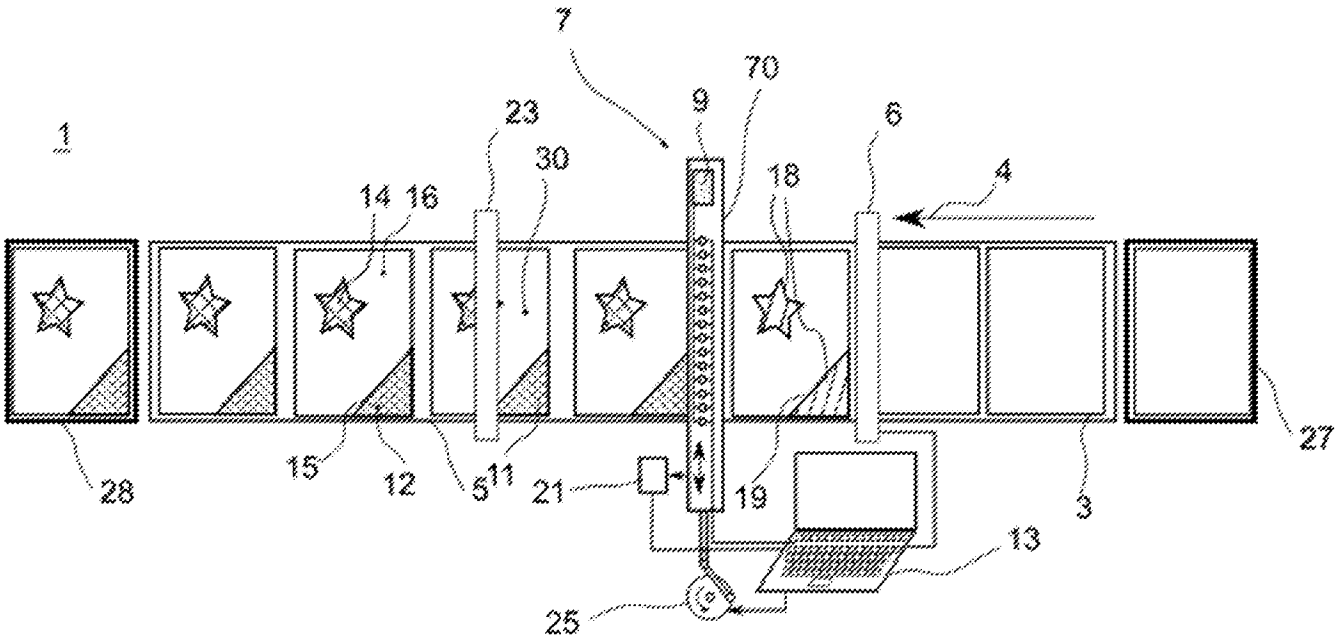
FIG. 2 shows a further embodiment, configured for inline coating.

FIG. 2 shows a variant of the embodiment illustrated in FIG. 1. In this variant a printing device 6 is provided upstream of the application device 7. Like the application device 7, the printing device 6 can be controlled and operated by the control device 13. In particular, the printing device 6 can be a digital printing device, preferably an inkjet printing device. First of all, on the substrates 3 in the form of printing sheets the printing device 6 produces the printed image 18, onto which the polymer coating 12 is then applied by the application device 7, leaving out regions 16 corresponding to the printed image 18.

By recognition of the position of the ink-jet nozzles 70 or, respectively, of the print head, according to a further embodiment of the invention, in the electronic control of the nozzles at the firing time for a droplet position on the substrate 3 the next nozzle for the firing can be selected. In this way, even with a very slight movement perpendicular to the substrate movement the formation of streaks and also the visibility of nozzle failures, as described for the scanning-mode, can be drastically minimized.

For this purpose, in a further embodiment of the invention without limitation to the exemplary embodiments illustrated in the drawings, it is provided that the pattern 14 of the coating is defined by an arrangement of target regions 140 lying adjacent to one another, wherein during the movement of the substrate 3 on the one hand and the periodic movement of the ink-jet nozzles 70 on the other hand a computer 19 determines which of the ink-jet nozzles 70 comes closest to a target region 140 or best matches this region and sends a control signal to this ink-jet nozzle 70, so that the nozzle 70 discharges a droplet 71 of the fluid application material 9 at the determined point 141 which comes closest to or best matches the target region 140.

In order to implement a position recognition, according to an embodiment of the invention at least one position sensor 21 is provided which detects the position of the ink-jet nozzles in the direction transversely to the feed direction, that is to say in the direction in which the ink-jet nozzles 70 are moved back and forth by means of the moving device 25. This embodiment is not necessarily associated with the embodiment explained above, in which the distance to a target region is determined.

The method with the droplet discharge and determination of the closest points is again illustrated with reference to FIG. 3.

Figure 3:
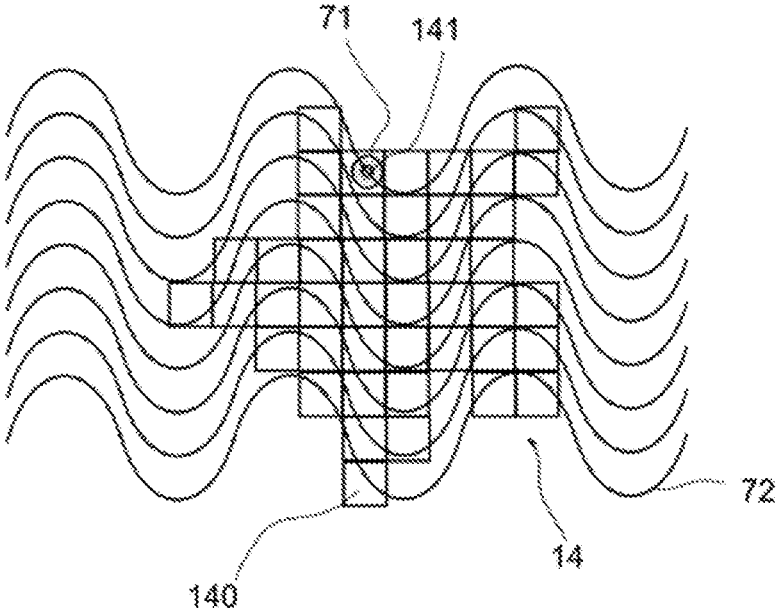
FIG. 3 shows an illustration of a droplet discharge with determination of the closest points.

FIG. 3 shows an arrangement of adjacent target regions 140 which together form an element of a pattern 14 of the polymer coating. The target regions are recorded in the control device 13, preferably in the form of data which as a print file control the nozzles, or which constitute a printed image of the polymer coating to be applied.

The tracks 72 of the ink-jet nozzles 70 form, as illustrated, a pattern of wavy lines lying adjacent to one another. The method of the droplet discharge is explained by way of example on one of the target regions 140 which here are shaped as boxes. The target region 140 is covered by two tracks 72, namely the two uppermost tracks. At a point 141 the upper one of these two tracks supplies the best match with the target region 140, since this point 141 comes closest to the center of the target region. At this point 141 the droplet 71 associated with the target region is then discharged, in order to form a part of the polymer film, which is still fluid, before the curing.

Figure 4:
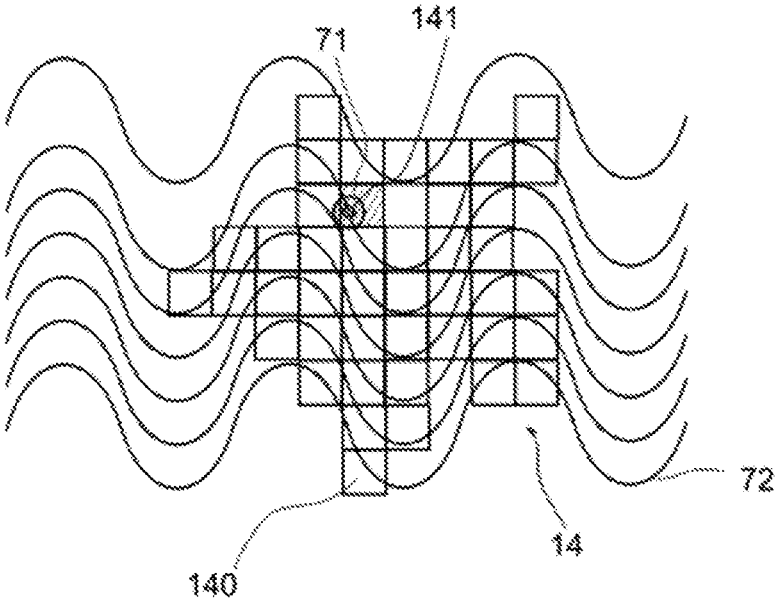
FIG. 4 shows an illustration of the droplet discharge in the event of failure of an ink-jet nozzle.

The method can also be used correspondingly in the event of failure of an ink-jet nozzle. This case is illustrated in FIG. 4. In the illustrated example it has been assumed that the second ink-jet nozzle 70 from the top has failed. Due to the pendulum motion of the nozzles it happens that target regions 140, for which the path of the failed nozzle normally offers the best match, are also either crossed by paths of other nozzles or at least very close. The method described above is now also carried out precisely as described for the present case, but without giving consideration to the track of the nozzle which is no longer functional. For clarity, one of the target regions 140 is identified by cross-hatching. It will be recognized that here the best match would be achieved with the missing track. The best approximation is now achieved with the track illustrated in FIG. 4 below the gap in the tracks, wherein in the illustrated example this track likewise crosses the target region 140. The respective ink-jet nozzle is controlled subject to calculation of its position and the distance or the match of this position with respect to the target region so that a droplet is discharged preferably in the greatest possible proximity to the center of the target region 140.

Even if a nozzle failure occurs which has not yet been recognized, the method is advantageous, since the nozzle failure appears as a statistical lack of dots and as such is not readily detectable. Without the described movement the nozzle failure would be very visible as a line.

For the inventive idea of the movement of the heads, or respectively of the ink-jet nozzles, it is advantageous if the location of the nozzles or of the print head during droplet ejection is known with a precision of <1 μm. This precision cannot be achieved by positioning by means of a positioning device (hysteresis).

For example, by means of linear encoders with corresponding read heads this precision can be ensured by position measurement, in that the control device determines and activates the ink-jet nozzle which according to the position measurement is best for droplet discharge to a specific target region 140. Other possibilities for position detection or precise positioning are conceivable. Furthermore, imprecision due to thermal expansion, in particular if fluid and nozzle heads are heated for viscosity adjustment, can be countered in that a read head is positioned in the first and in the last nozzle of a print head, or more generally the position thereof is determined by means of at least one position sensor 21. In general, the position recognition can take place by means of a feedback loop.

A further embodiment of the invention, which is suitable as an alternative or in addition to the pendulum movement of the nozzles as described above for preventing streaks in the coating, is described below. This embodiment relates to the use of a plurality of rows of ink-jet nozzles, which are arranged staggered in the feed direction.

The use of a plurality of rows of ink-jet nozzles, or even a plurality of rows of print heads which in turn have a plurality of nozzles, can pursue further aims in addition to the above-mentioned purpose of generating statistics in the nozzle selection along a droplet path on the substrate in parallel with the direction of movement of the substrate.

One of these aims is to increase the layer thickness or, in the case of application of printing inks, the depth of color, by printing a plurality of images one above the other. For coating with relief coating applications, the method is suitable for producing high layer thicknesses at higher substrate speeds. During application by ink-jet nozzles the layer thickness can be influenced by means of a plurality of parameters. Mention should be made here of the droplet size. The larger the droplets with a constant pattern width, the larger the achievable layer thickness is. In general, without limitation to the specific embodiments, even regardless of whether a plurality of nozzle rows are used, according to a further embodiment of the invention it is therefore provided that by means of a control device the ink-jet nozzles are controlled so that they discharge droplets of different sizes, so that the applied quantity of fluid is adapted following a stipulation. The stipulation can be recorded in particular in a print file, by means of which the control device 13 controls the ink-jet nozzle 70.

In print heads of modern construction, a distinction is made between the native drop and a size scaling by multiple droplet ejection, wherein the individual droplets in flight come together to form a larger droplet. The native droplet size is usually only adjustable within a narrow range for each print head. A broadening of the possibilities for controlling commercially available ink-jet print heads which are controlled by piezoelectric actuators, is described for example in WO2017/009705 A1. According to this method the native droplet size can be varied within significantly wider limits.

Moreover, a print head can only be adjusted within a certain frequency range (droplets per unit of time). The latter characteristic is dependent upon the construction and the type of droplet production. Thus, the production of larger droplets by combination of individual droplets according to the described method is at the expense of the possible droplet frequency, since the limitation of the frequency applies for the individual droplets. Due to the possible variations of the individual droplets according to WO2017/009705 A1 a multiplication of the droplets in a pulse is possible through the significantly shorter pulses at the same frequency.

In addition to the droplet size the pattern width can be varied. In a single-pass machine the pattern width is usually defined by the nozzle spacing. In ongoing operation with fixed geometry no changes can be carried out here.

In the direction of the substrate movement the droplets can be positioned closer together (reduction in the pattern width in the running direction of the substrate) in order to achieve higher layer thicknesses. When only one nozzle row is used, the coating thickness which can be achieved is speed-dependent due to the limitation of the frequency of the droplet ejection.

The consequence of this is that higher coating thicknesses give rise to a slowing down of the printing process. Thus, in addition to a lower productivity the achievable minimum line width is also limited, since the slowing down of the substrate movement simultaneously results in a longer elapsed time for the applied layer and the pressure on the edges of the relief structures increasing with a higher layer thickness.

Last but not least, in addition to the productivity the quality of the achievable relief coatings is also restricted. Even if this can be partially compensated for by the use of pre-curing devices (pinning lamps) placed close to the print heads, a higher machine speed is desirable.

When a plurality of print head rows are used, as stated above, these disadvantages are compensated for. Simultaneously the image quality benefits from the use of a plurality of nozzles per dot, which is also advantageous for compensation for the streak formation and nozzle failures is advantageous.

Figure 5:
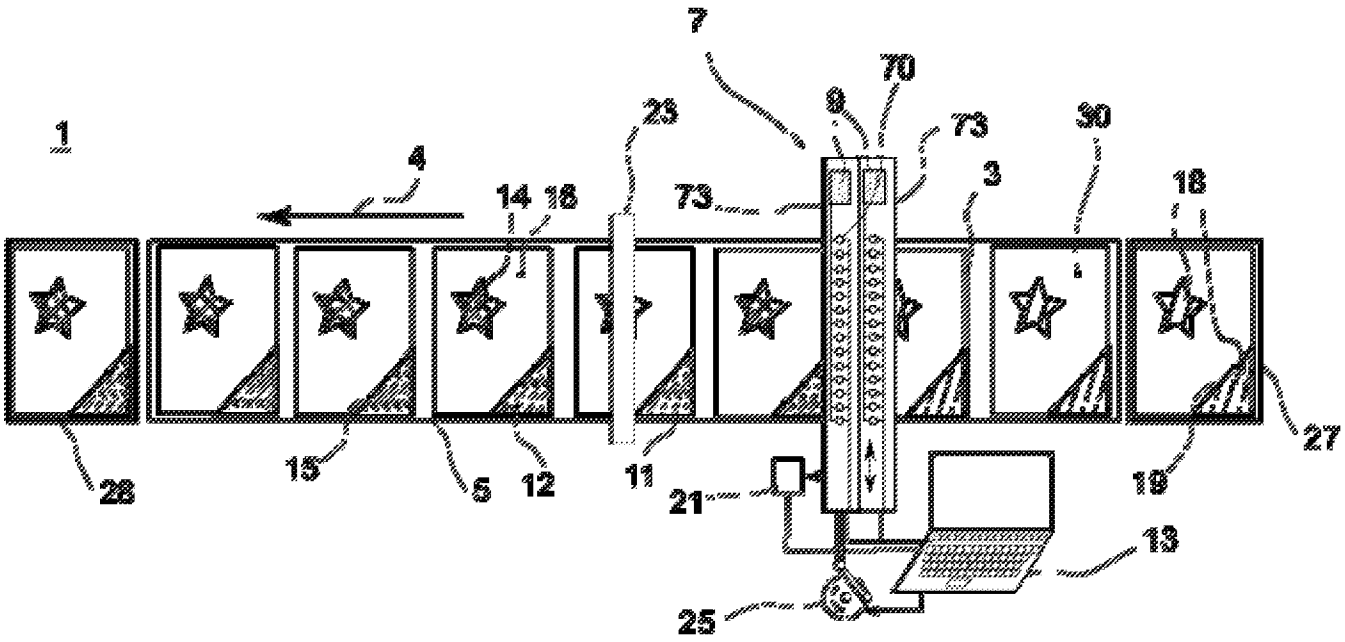
FIG. 5 shows a variant of the embodiment illustrated in FIG. 1 with a plurality of nozzle rows.

Thus, according to one embodiment of the invention it is accordingly provided that the plurality of rows of ink-jet nozzles 70 are arranged staggered or offset in the feed direction 4, so that target regions on the substrate which are defined in their extent by the surface area covered by the impinging droplets are travelled over by a plurality of ink-jet nozzles 70. In particular a respective ink-jet nozzle per nozzle row can also travel over the respective target region. FIG. 5 shows an example with two nozzle rows 73 which are arranged staggered one behind the other in the feed direction 4. In the direction perpendicular to the feed direction 4 the nozzles have the same positions, so that they each travel over the same target regions on the substrate 3. A moving device 25 can be provided, as also in the exemplary embodiment illustrated in FIG. 1. In this case it can be provided that the moving device 25 only moves one of the nozzle rows or some of the nozzle rows 73. In this case the ink-jet nozzles of various rows are displaced relative to one another. Likewise, however, it is possible to move all nozzle rows 73 jointly, for instance in that the nozzle rows 73 are mechanically interconnected.

When a plurality of nozzle rows 73 are used, the printed image can be differently divided up statistically or following a rule. This ranges from simple alternation between the nozzle rows by means of a chequerboard pattern to statistical or quasistatistical patterns. Thus, generally, without being limited to the illustrated exemplary embodiments, in a further embodiment of the invention it is provided that the target regions along a path travelled over by a nozzle are coated by a plurality of nozzles, alternating with one another and arranged one behind the other, from the different nozzle rows. Streaks in the polymer coating can be suppressed by this measure, as likewise by the pendulum movement of the nozzles as described above. This embodiment can therefore be provided alternatively or also in addition to the pendulum movement.

In general, therefore, according to an embodiment of the invention a method for printing sheet-type substrates is provided, in which

- a substrate 3 is moved in a feed direction 4 past an application device 7 by means of a conveying device 5 and
- during the movement of the substrate the application device 7 applies a fluid application material 9 drop by drop to the surface 30 of the substrate 3 forming a film 11 in a pattern 14 with a pre-defined contour 15, in particular leaving out regions 16, through a plurality of ink-jet nozzles 70 arranged in a plurality of nozzle rows transversely to the feed direction, in response to computer-controlled switching signals, wherein
- target regions 140 arranged one behind the other in the feed direction on the substrate 3 are alternately printed by a plurality of ink-jet nozzles 70 arranged one behind the other in the feed direction and thus belonging to different nozzle rows 73.

In the case of a curable organic fluid coating material for producing polymer coatings, after the application the film 11 is cured to a firm polymer coating 12.

Figure 6:
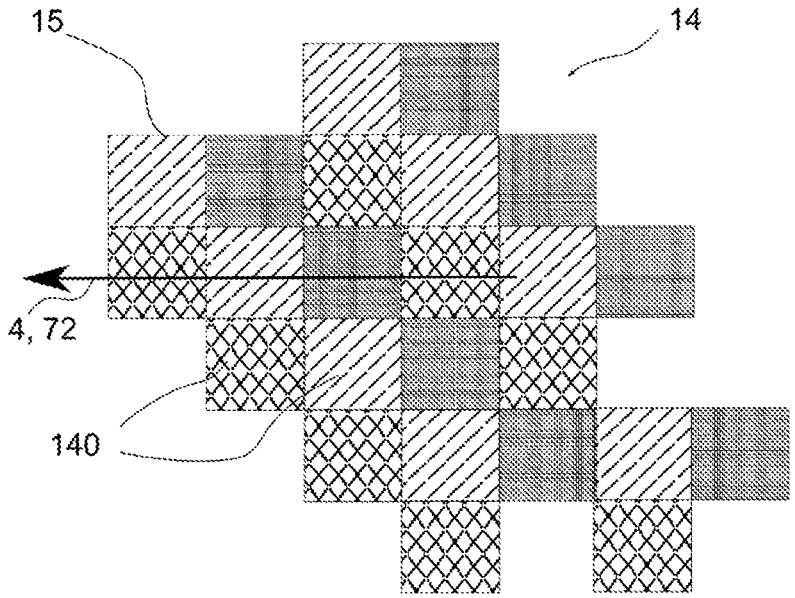
FIG. 6 and FIG. 7 show coated regions on a substrate.
Figure 7:
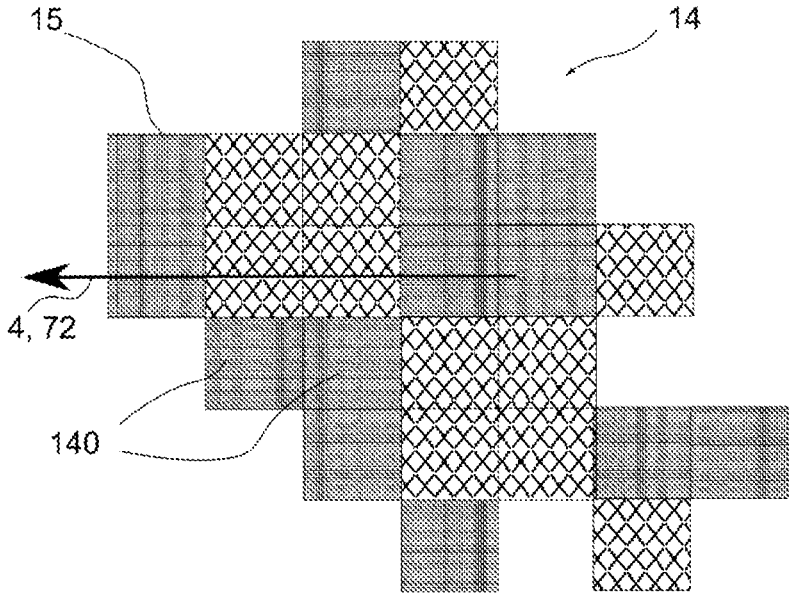

For clarification, FIG. 6 and FIG. 7 show two examples of coating patterns 14. The coating patterns 14 are divided according to a pixel representation into an arrangement of target regions 140. These are lined up one behind the other in the transport direction 4. If no pendulum movement of the ink-jet nozzles 70 takes place, the paths 72 of the nozzles are colinear with the transport direction. The target regions 140 coated by the ink-jet nozzles of a specific nozzle row 73 are each represented by the same hatching. In the example illustrated in FIG. 6, three different hatchings alternate progressively in a row in the transport direction 4. Thus, three nozzles, each from a different nozzle row, are operated sequentially.

In the example illustrated in FIG. 7, an alternating, sequential operation of two nozzle rows takes place according to a chequerboard pattern. In each case two ink-jet nozzles 70 of one of the nozzle rows are jointly operated, the adjacent two ink-jet nozzles of the nozzle row stop. Two ink-jet nozzles 70 of the next nozzle row 73 stand in for these non-operational nozzles. This pattern alternates according to two target regions which succeed one another in the transport direction 4, so that now the ink-jet nozzles 70 which in each case were not activated previously are operated.

According to a further aspect, an arrangement for determination of position, as in the example according to FIG. 1, can also be used for self-adjustment of the print heads. The idea is generally that in when at least one determination of position per print head is used a plurality of print heads can be arranged roughly relative to one another and, with a knowledge of the position data, a calibration is carried out.

Figure 8:
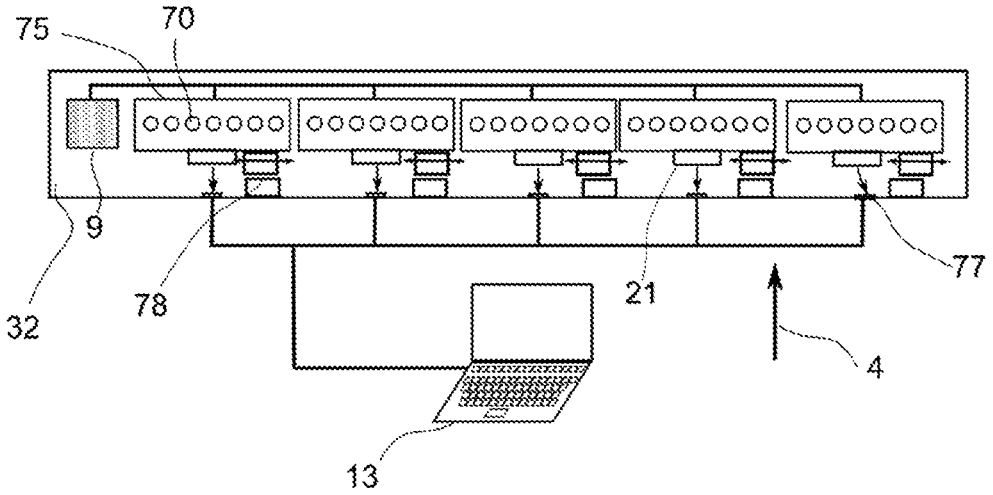
FIG. 8 shows an arrangement of a holder with a plurality of print heads.

In this connection, for clarification, FIG. 8 shows an example for an arrangement for carrying out this embodiment. The ink-jet nozzles 70 are usually integrated in print heads 75. These print heads 75 are fixed on a holder 32 adjacent to one another transversely to the feed direction 7 of the device 1. Due to tolerances the actual position can differ slightly from the provided position. A displacement of position transversely to the feed direction 4 is particularly critical here, since it can in turn lead to the occurrence of visible streaks in the polymer coating. The illustration is purely schematic. Thus, unlike the illustration, the print heads 75 can be arranged one behind the other in two rows, in order keep the nozzle spacing between the nozzles of two heads transversely to the feed direction precisely as great as the spacing of adjacent nozzles inside a print head. In a similar manner, an arrangement of the nozzle rows in a similar manner is also an arrangement the nozzle row in a herringbone pattern is possible.

Position sensors 21 which in each case precisely determine the position of the print head are now associated with the print heads 75. Position markers 77 can be provided, for example, for determination of position. For clarification, the print head shown at the far right is slightly displaced laterally, so that the directional arrow shown extends slightly obliquely from the position sensor 21 to the marker 77. According to one embodiment of the invention, the interaction of these heads for a printed image is achieved by the combination of a knowledge of the position and measurement of a specific printed image. For this purpose it is provided that a printed image produced by the print heads 77 is recorded, in particular scanned in, deviations from the required image are determined, changes of position for the print heads 77 are determined from the deviations, and the positions of the print heads are changed by means of a positioning device 78 until the positions measured by means of the position sensors 21 match the specified changes of position.

Furthermore, a very advantageous modular and low-maintenance construction can be achieved with the position sensors.

If the print heads 77 of a printing unit are equipped with a position detector, the arrangement can be roughly as described vaguely above and, by the use of the precise position and computation of the interaction, the orientation relative to one another can be put into operation very quickly for a consistent printed image. For this purpose, according to one embodiment of the invention, the nozzle positions determined from a test print are used as a basis in order to assign each nozzle to a specific position for the printing. In the case of overlaps, either a redundant nozzle is not used, or a pattern is assigned according to which the redundant nozzles are used alternately. In such an arrangement, relatively large gaps between the nozzle, for example due to a relatively large distance between two print heads 77 and thus due to the distance from the adjacent nozzles of the print heads, should be avoided as far as possible, since these gaps are only alleviated statistically by the movement of the nozzle rows described above, but it may not be possible to hide them completely.

Nowadays this can only be achieved by means of costly mechanical solutions in which the print heads are either aligned passively with corresponding positioning pins or are actively aligned by installed mechanical or electronic means for adjustment of lateral displacement and angle. The positioning usually also takes place by means of a test image and subsequent successive adjustment of the individual head positions.

Figure 9:
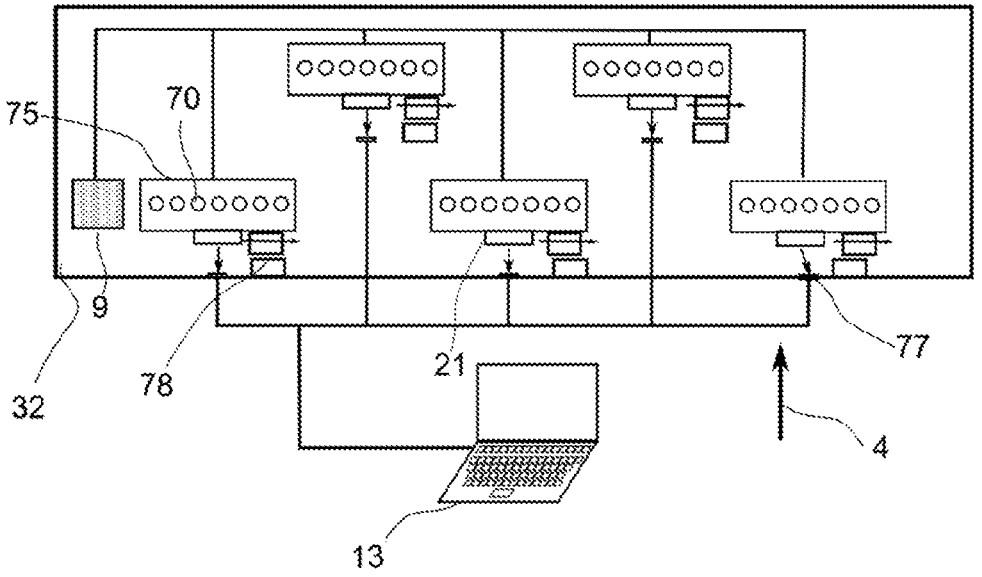
FIG. 9 shows a variant of the arrangement shown in FIG. 8 with print heads arranged staggered in a plurality of rows.

In order to avoid gaps between the individual print heads and thus relatively large distances between the outer nozzles of adjacent print heads, it is generally favorable to arrange the print heads 75 in a plurality of rows, wherein the print heads 75 overlap transversely to the feed direction 4. As a result, the outer ink-jet nozzles 70 of adjacent print heads 75 are spaced apart in the feed direction 4, but for this purpose, when viewed in the feed direction 4, they can be positioned in any way relative to one another in particular also with uniform spacing. FIG. 9 shows such an arrangement with two rows of print heads 75 staggered one behind the other in the feed direction 4.

If it is possible to dispense with mechanical precision, by retrospective measurement, the costs and effort are considerably lower. If each print head then has its own electronic control means and a dedicated liquid supply (piggyback tank), any complex printing units can be constructed relatively simply.

In this connection it is provided according to one embodiment that the print heads 77 are provided with a positioning device in a direction transversely to the transport direction 4 with a position detector, a voltage supply, preferably a fluid supply (for example a hose connection with hydrostatic liquid pressure or respective pump with connection to a reservoir) and a network connection for connection to the control device 13. As illustrated in FIG. 8, in this case it is favorable if the position sensors 21 form part of the print heads 77.

Thus, to summarize, according to this embodiment of the invention a device 1 for printing sheet-type substrates is provided, comprising an application device 7, a control device 13 and a conveying device 5, in order to move a substrate 3 in a feed direction 4 past the application device 7, wherein the application device 7 comprises a plurality of print heads 77 arranged in a row transversely to the feed direction, each having a plurality of ink-jet nozzles 70, and the control device 13 is configured for generating computer-controlled switching signals by means of which the ink-jet nozzles 70 dispense a fluid application material 9 drop by drop, wherein the control device 13 is furthermore configured to actuate the ink-jet nozzles in such a way that a fluid film 11 of the application material is applied to the surface 30 of a passed substrate 3 in the form of a pattern 14 having pre-defined contours 15, in particular leaving out regions 16, wherein the print heads 77 are in each case designed as a unit with a position sensor 21, a fluid supply device for supplying the ink-jet nozzle 70 with the fluid application material 9, a computer-controlled positioning device 78, in particular adjustable by means of the control device 13, for adjusting the position of the print head transversely to the feed direction, and also a connector, preferably a network connector for connection to the control device 13.

If the device is designed to produce polymer coatings by means of a fluid organic coating material, the device 1 can have a curing device 23 in order to cure the fluid film 11 to a firm polymer coating 12 after the application.

The adjustment of the print head position does not have to take place by means of a printed image. In general, the embodiment described above can serve first of all for adjusting the arrangement of the print heads 77 relative to one another as exactly as possible, even if inaccuracies are present in the assembly. The inaccuracies are compensated for by the positioning devices with reference to the measured position data. This adjustment can be performed by the control device 13 but, if need be, it can also be performed by a computing device in the print head 77. Furthermore, the position data do not necessarily reproduce positions relative to a holder. According to a further embodiment of the invention it is provided that the position sensors 21 are configured to determine relative positions with respect to other print heads. Thus, an exact orientation of the print heads 77 relative to one another can be achieved by adjustment.

In a further embodiment of the invention the activation of the ink-jet nozzles can also take place taking account of the measured position. Print data or activation signals for the ink-jet nozzles 70 can then be corrected, even if the position of the print head does not exactly match the provided position.

Figure 10:
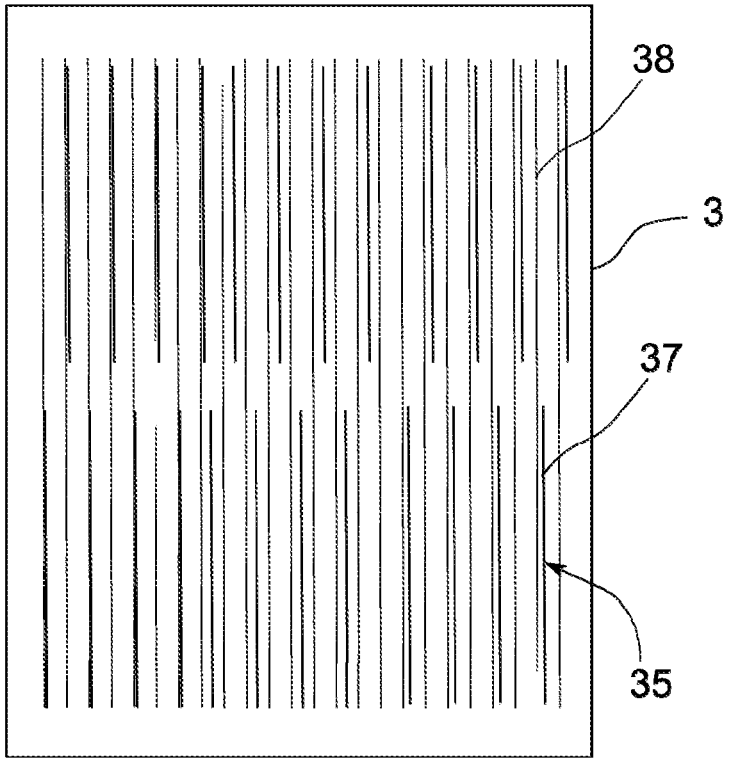
FIG. 10 shows a test image for calibration of the positions of the print heads.

FIG. 10 shows schematically a test image 35 on a substrate 3, by means of which the activation signals of the nozzles are corrected or adapted in order to obtain the most uniform printed image possible. As shown in FIG. 10, the test image 35 can be formed from lines 37 printed by individual nozzles. The required positions 38 of the lines 37 are shown in FIG. 10 as broken lines. In order to prevent the lines 37 from being too close to one another or even running into one another, the lines of adjacent nozzles can be applied offset with respect to one another in the feed direction, as illustrated.

As described above, the produced printed image can be recorded, for example, by scanning in or photographing the test image 35. Deviations from the required image are then determined. From the deviations it is then possible to determine changes of position for the print heads and the positions of the print heads are changed by means of a positioning device 78 until the positions measured by means of the position sensors 21 match the specified changes of position. According to an alternative or additional embodiment, with given positions of the print heads it is also possible to select nozzles by means of the proximity to the required position. If, for example, two nozzles are located at the same position, as described in the text either one nozzle can be selected or a pattern for alternating the nozzles can be determined. The activation times of the nozzles can be adapted so that the droplet discharge of the nozzles is as close as possible to the respective required position 38.

The invention can generally be implemented in a particularly advantageous manner with a modular construction. In such a modular construction print modules 81 are connected to form an applicator device 7. In this case the applicator device 7 contains all of the print heads of a printing device 1 according to the invention.

Figure 11:
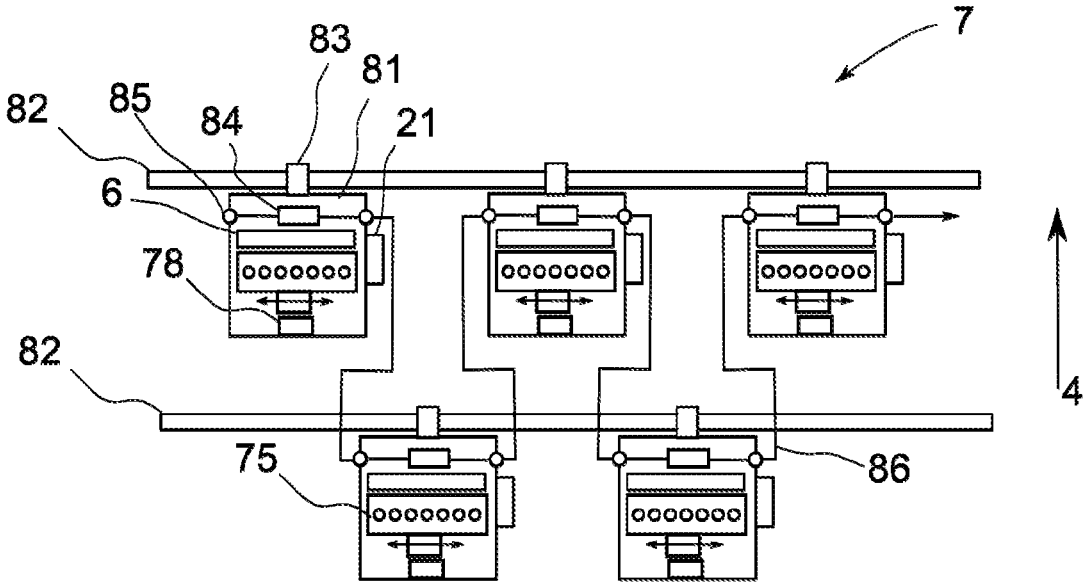
FIG. 11 shows a printing unit with a modular construction.

The print modules 81 can in particular be fastened by means of suitable shaft fastenings 83 adjacent to one another on a cross-member or shaft 82. In the example illustrated in FIG. 11 the modules 81 are arranged staggered in two rows corresponding to the example of FIG. 9. For this purpose, the print modules 81 are mounted on two shafts 82 positioned one behind the other in the feed direction 4.

The print modules 81 in each case comprise at least one print head 75. In order to carry out the method described above with the correction of the printed image, each module can be equipped with a position sensor 21. According to a simple embodiment the position sensor can measure a relative displacement for instance by the sensor measuring the distance to the adjacent print module 81. It is likewise possible to provide one or more position markers. Thus, an encoder ruler which extends along the shaft 82 can be provided as a position marker.

Furthermore, a print module 81 can comprise a control electronics 84 which can perform the activation of the print head 75, and where appropriate further functions, such as for instance the communication with a higher-level control device 13 and/or position correction calculations.

A print module 81 has an electronic interface 85 at least for transmission of the pressure data. The power supply can also be provided by means of the interface.

Furthermore, connectors for supplying the tank with the fluid to be applied can also be provided, and also, if required, a connection for supply of the tank with controlled negative pressure.

It is preferable if, as in the illustrated example, the print modules 81 are connected to one another by connecting lines. In the example the connecting lines are in each case drawn between the interfaces 85 of adjacent modules 81. Likewise, it is possible to connect the printing modules to a common bus.

The print modules 81 can be roughly aligned with one another on the shaft 82. By printing of a nozzle test pattern and digital recording of the pattern the relative positions of the print heads 75 can be determined with respect to one another and the structure of the printed image can be fixed by means of the specified positions. The nozzle rows of the print heads should preferably fit together at least without a gap, but ideally a certain overlap is set, and the redundant nozzles are operated by means of an activation pattern. The advantage of this type of calibration is that the mechanical alignment of the heads relative to one another as explained above does not have to be in the region of the otherwise conventional tolerances.

Due to the position sensors 21 the alignment of the printed image can be controlled appropriately for the head movement in order to avoid streaking. Unfavorable head positions (for example with 1.5 times nozzle spacing) can be corrected in a targeted manner. However, this can also take place electronically.

A significant advantage arises out of the possibility of calibrating the printing unit at operating temperature.

In order to achieve the movement of the print heads 75 back and forth to avoid streaking, positioning devices 78 which can move the print head 75 relative to the print module and transversely to the feed direction can be integrated in each case into the print modules 81.

The modular construction of the applicator device 7 described above is particularly advantageous in order to be able to simply expand a printing device. In order for example to achieve a required printing width, an appropriate number of print modules can simply be mounted on one or more shafts and connected to one another. The lateral adjustment of the print heads then takes place for example with the aid of a test image and/or also by the evaluation of the data of the position sensors.

Without limitation to the specific example illustrated, the invention provides a device 1 for printing sheet-type substrates, comprising an application device 7, a control device 13 and a conveying device 5, in order to move a substrate 3 in a feed direction 4 past the application device 7, wherein the application device 7 comprises a plurality of print modules 81 which are releasably fastened and offset transversely to the feed direction 4 on at least one shaft 82 and in each case have at least one print head 75, wherein the print modules 81 in each case have a tank, a control electronics 84 and an interface 85, wherein the print modules 81 can be coupled to one another by means of their interfaces for exchange of data, and wherein the printing width of the device 1 can be adapted in that print modules 81 are fastened to the shaft 82 and are connected by means by of their interface 85 to the control device 13 (not shown in FIG. 1).

The movement of the print heads back and forth is also particularly advantageously implemented in the modular construction of the device described above. In this way mechanical inaccuracies in the assembly of the modules on the shaft equalized can be compensated for. In order to implement the movement, a positioning device 78 can be provided on the shaft or shafts 82. However, it is also advantageous if the modules 81 in each case have such positioning devices 78. This simplifies the mechanics of the application device. In particular, however, a positioning device 78 integrated in the module 81 makes it possible to carry out different movements of the print heads 75 of the modules 81.

| List of references | |
|---|---|
| Device for polymer coating | 1 |
| substrate | 3 |
| feed direction | 4 |
| conveying device | 5 |

-continued

| List of references | |
|---|---|
| tank | 6 |
| application device | 7 |
| application material | 9 |
| fluid film | 11 |
| control device | 13 |
| pattern | 14 |
| firm polymer coating | 12 |
| contour of 14 | 15 |
| region left out | 16 |
| printed image | 18 |
| contour of 18 | 19 |
| position sensor | 21 |
| curing device | 23 |
| moving device | 25 |
| magazine | 27, 28 |
| surface of 3 | 30 |
| holder | 32 |
| test image | 35 |
| printed line | 37 |
| required position of 37 | 38 |
| ink-jet nozzle | 70 |
| droplet | 71 |
| path of 70 | 72 |
| nozzle row | 73 |
| print head | 75 |
| position marker | 77 |
| positioning device | 78 |
| print module | 81 |
| axis | 82 |
| shaft fastening | 83 |
| control electronics | 84 |
| interface | 85 |
| connecting line | 86 |
| target region | 140 |
| point on 72 which best matches 140 | 141 |

The invention claimed is:

1. A method for printing sheet-type substrates, comprising:

moving a substrate in a feed direction past an application device by means of a conveying device, during the movement of the substrate, applying with the application device a fluid application material drop by drop to a surface of the substrate in a pattern with a pre-defined contour leaving out regions, through a plurality of ink-jet nozzles arranged in a row transversely to the feed direction, in response to computer-controlled switching signals, and during the application of the pattern and during the movement of the substrate, moving the ink-jet nozzles back and forth transversely to the feed direction, in the longitudinal direction of the arranged row of ink-jet nozzles, such that the paths travelled by the nozzles over the substrate by the overlap of a movement of the ink-jet nozzles back and forth with a movement of the ink-jet nozzles in the feed direction have direction components running perpendicular to the feed direction, wherein the printing of the substrate is completed in a single-pass, wherein a film of fluid organic coating material is applied as a fluid application material, and after the application, the film is cured to a firm polymer coating, wherein a maximum distance between a leftmost nozzle position and a rightmost nozzle position during the back and forth movement of the ink-jet nozzles is not greater than five times the nozzle spacing, and wherein, the pattern of the coating is defined by an arrangement of target regions lying adjacent to one another, and further comprising, during the movement of the substrate on the one hand and the periodic movement of the ink-jet nozzles on the other hand, determining with a computer which of the ink-jet nozzles- comes closest to a target region or best matches this region and sending with the computer a control signal to this ink-jet nozzle, so that the nozzle discharges a droplet of the fluid application material at the determined point which comes closest to or best matches the target region.

2. The method according to claim 1, further comprising measuring with at least one position sensor the position of the ink-jet nozzles in the direction in which the ink-jet nozzles are moved back and forth by means of the moving device.

3. The method according to claim 1, wherein the substrate provided with a printed image is provided with the polymer coating in such a way that the printed image corresponds to the pattern of the coating, such that the contours of the printed image and the pattern extend at least partially in parallel.

4. The method according to claim 1, further comprising activating the ink-jet nozzles by means of a control device so that they discharge droplets of different size, so that the layer thickness is adapted following a stipulation, wherein the stipulation is stored in a print file, by means of which the control device controls the ink-jet nozzle.

5. The method according to claim 1, wherein target regions arranged one behind the other in the feed direction are alternately printed by a plurality of ink-jet nozzles arranged one behind the other in the feed direction.

6. The method according to claim 1, wherein the ink-jet nozzles are integrated in a plurality of print heads, wherein a position sensor is in each case associated with the print heads, and further comprising:

recording a printed image produced by the print heads, determining deviations from the required image, determining changes of position for the print heads from the deviations, and changing the positions of the print heads by means of a positioning device until the positions measured by means of the position sensors match the specified changes of position.

7. A device for printing sheet-type substrates, comprising:

an application device, a control device and a conveying device, in order to move a substrate in a feed direction past the application device, and a computer, wherein:

the application device comprises a plurality of print heads arranged in a row transversely to the feed direction, and the control device is configured for generating computer-controlled switching signals by means of which the ink-jet nozzles dispense a fluid application material drop by drop, wherein:

the control device is furthermore configured to actuate the ink-jet nozzles in such a way that a fluid film of the application material is applied to the surface of a passed substrate in the form of a pattern having pre-defined contours, in particular leaving out regions, wherein:

a moving device for moving the inkjet nozzles in a single-pass mode is provided in order during the application of the pattern and during the movement of the substrate the ink-jet nozzles are moved back and forth transversely to the feed direction, in the longitudinal direction of the arranged row of ink-jet nozzles, such that the paths travelled by the nozzles over the substrate by the overlap of a movement of the ink-jet nozzles periodically back and forth with a movement of the ink-jet nozzles in the feed direction have direction components running perpendicular to the feed direction, wherein the pattern of the coating is defined by an arrangement of target regions lying adjacent to one another, wherein a maximum distance between a leftmost nozzle position and a rightmost nozzle position during the back and forth movement of the ink-jet nozzles is not greater than five times the nozzle spacing, and wherein the computer is configured to determine during the movement of the substrate on the one hand and the periodic movement of the ink-jet nozzles on the other hand, which of the ink-jet nozzles comes closest to a target region or best matches this region, and to send a control signal to this ink-jet nozzle, so that the nozzle discharges a droplet of the fluid application material at the determined point which comes closest to or best matches the target region.

8. The device according to claim 7, wherein at least one position sensor which measures the position of the ink-jet nozzles in the direction in which the ink-jet nozzles are moved back and forth by means of the moving device.

9. The device according to claim 7, further comprising a plurality of rows of ink-jet nozzles, which are arranged staggered in the feed direction.

10. The device according to claim 7, wherein the control device is configured to activate the ink-jet nozzles so that they discharge droplets of different size, so that the applied quantity of fluid is adapted following a stipulation, in particular wherein the control device is configured to control the ink-jet nozzles by means of a print file in which the stipulation is stored.

11. The device according to claim 7, further comprising a plurality of print heads which in each case have a plurality of ink-jet nozzles, wherein the print heads are in each case designed as a unit with a position sensor, a fluid supply device for supplying the ink-jet nozzles with the fluid application material, a computer-controlled positioning device, in particular adjustable by means of the control device, for adjusting the position of the print head transversely to the feed direction, and also a connector, preferably a network connector for connection to the control device.

12. The device according to claim 7, further comprising a curing device in order to cure the fluid film to a firm polymer coating after the application.

13. The device according to claim 7, wherein the application device comprises a plurality of print modules which are releasably fastened and offset transversely to the feed direction on at least one shaft and in each case have at least one print head, wherein the print modules in each case have a tank, a control electronics and an interface, wherein the print modules can be coupled to one another by means of their interfaces for exchange of data.

14. The device according to claim 13, wherein the device is configured for an expansion of the printing width, wherein one or more print modules are fastened to the shaft and are connected by means by of their interface to the control device.

* * * * *